United States Patent [19]

Plasko

[11] 4,109,229

[45] Aug. 22, 1978

[54] THERMALLY ACTUATABLE ELECTRICAL SWITCH SUBASSEMBLY THEREOF

[75] Inventor: Emil Robert Plasko, Washington Township; Montgomery County, Ohio

[73] Assignee: Emerson Electrical Co., St. Louis, Mo.

[21] Appl. No.: 716,579

[22] Filed: Aug. 23, 1976

[51] Int. Cl.[2] ..... H01H 37/76

[52] U.S. Cl. ..... 337/408; 337/409

[58] Field of Search ..... 337/407, 408, 409, 180

[56] References Cited

U.S. PATENT DOCUMENTS

| | | | |
|---|---|---|---|
| 3,274,361 | 9/1966 | Ebensteiner et al. | 337/180 X |
| 3,820,050 | 6/1974 | Tyler et al. | 337/408 |
| 3,821,685 | 6/1974 | Kimball et al. | 337/409 |
| 3,930,215 | 12/1975 | Sehor | 337/409 X |
| 3,944,960 | 3/1976 | Audette et al. | 337/409 X |

*Primary Examiner*—George Harris

*Attorney, Agent, or Firm*—Candor, Candor & Tassone

[57] ABSTRACT

A thermally actuatable electrical switch construction having a deformable contact member normally disposed in electrical contact with a stationary contact member while a temperature sensitive member of the construction is in a solid condition and being deformed out of contact with the stationary contact member by deforming means of the construction when the temperature sensitive member is rendered non-solid by sensing a temperature above a predetermined temperature, the deformable contact member being deformed in a direction toward the temperature sensitive member by the deforming means when the temperature sensitive member is rendered non-solid and being carried by a lead that projects into the switch construction whereby the lead and the deformable contact member define a subassembly that is adapted to be initially inserted into the construction to be secured thereto.

14 Claims, 4 Drawing Figures

THERMALLY ACTUATABLE ELECTRICAL SWITCH SUBASSEMBLY THEREOF

This invention relates to an improved thermally actuatable electrical switch construction and to a method of making the same as well as to a subassembly for such a switch construction and a method of making such subassembly.

It is well known that thermally actuatable electrical switch construction can be provided having a deformable contact member normally disposed in electrical contact with a stationary contact member while a temperature sensitive member of the construction is in a solid condition and being deformed out of contact with a stationary contact member by deforming means of the construction when the temperature sensitive member is rendered non-solid by sensing a temperature above a predetermined temperature. For example, see the U.S. Pat. to Senor, No. 3,930,215 and the U.S. Pat. to Audette et al., No. 3,944,960.

However, the deforming means of such prior known thermally actuatable electrical switch constructions each requires the deformable contact member to be deformed away from the temperature sensitive member and requires the contact member to be deformed in place by a lead that is to medially contact the same during the assembly of the switch construction whereby many parts are required that must be individually assembled into the casing of the switch construction.

Therefore, it is a feature of this invention to provide an improved thermally actuatable electrical switch construction of the above type wherein the deformable contact member can be deformed toward the temperature sensitive member and/or wherein the contact member can be carried by the lead that medially contacts the same whereby a plurality of the parts can be formed into a subassembly that can be readily assembled into the casing of the switch construction to facilitate the making thereof.

In particular, one embodiment of this invention provides a thermally actuatable electrical switch construction having a deformable contact member normally disposed in electrical contact with a stationary contact member while a temperature sensitive member of the construction is in a solid condition and being deformed out of contact with the stationary contact member by deforming means of the construction when the temperature sensitive member is rendered nonsolid by sensing a temperature above a predetermined temperature, the deformable contact member being deformed in a direction toward the temperature sensitive member by the deforming means when the temperature sensitive member is rendered non-solid. The deformable contact member is secured to a lead of the construction that projects therein whereby the lead and the deformable contact member can be assembled as a subassembly into the casing of the switch construction during the making thereof.

Accordingly, it is an object of this invention to provide an improved thermally actuatable electrical switch construction having one or more of the novel features of this invention as set forth above or hereinafter shown or described.

Another object of this invention is to provide an improved method of making such a thermally actuatable electrical switch construction, the method of this invention having one or more of the novel features set forth above or hereinafter shown or described.

Another object of this invention is to provide a subassembly for such a thermally actuatable electrical switch construction, the subassembly of this invention having one or more of the novel features as set forth above or hereinafter shown or described.

Another object of this invention is to provide a method of making such a subassembly, the method of this invention having one or more of the novel features set forth above or hereinafter shown or described.

Other objects, uses and advantages of this invention are apparent from a reading of this description which proceeds with reference to the accompanying drawings forming a part thereof and wherein.

Figure 1:
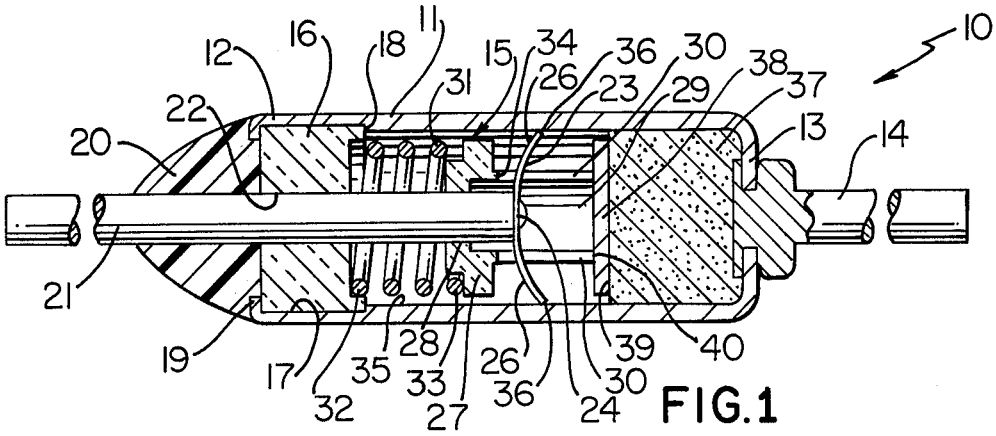
FIG. 1 is a cross-sectional view illustrating the inproved thermally actuatable switch construction of this invention.

While the various features of this invention are hereinafter described and illustrated as being particularly adapted to provide a thermally actuatable electrical switch construction, it is to be understood that the various features of this invention can be utilized singly or in any combination thereof to provide other types of electrical switch constructions as desired.

Therefore, this invention is not to be limited to only the embodiment illustrated in the drawings, because the drawings are merely utilized to illustrate one of the wide variety of uses of this invention.

Referring now to FIG. 1, the improved thermally actuatable electrical switch construction of this invention is generally indicated by the reference numeral 10 and comprises an open ended conductive casing 11 having an open end 12 and a closed end 13, the closed end 13 of the casing 11 having an external lead 14 secured thereto in any suitable manner so as to be electrically interconnected to the casing 11.

A subassembly of this invention is generally indicated by the reference numeral 15 in FIG. 3 and comprises an insulating end plug 16 adapted to be received in a counter bore 17 in the open end 12 of the casing 11 in a manner hereinafter described to abutt against an internal shoulder 18 thereof whereby the left-hand end 19 of the casing 11 can be turned over to secure the end plug 16 within the open end 12 of the casing 11 as illustrated in FIG. 1 and thereby close the open end 12 which is adapted to be further sealed closed by an epoxy resin sealing means 20 in a manner well known in the art.

The end plug 16 of the subassembly 15 has an electrical lead 21 disposed through an opening 22 and is press-fitted therein or otherwise secured thereto so that the end plug 16 and lead 21 are self-contained and can be inserted in the open end 12 of the casing 11 as a subassembly in a manner hereinafter described.

A conductive ribbon-like contact member 23 has its medial portion 24 secured to the end 25 of the lead 21 in any suitable manner, such as by spot welding, so that opposed spring fingers 26 of the contact member 23 extend radially outwardly from the end 25 of the lead 21 and have a normal bias to be disposed substantially vertically in the drawings.

However, a collar-like deforming member of electrical insulating material 27 is telescopically disposed on the lead 21 intermediate the end plug 16 and contact member 23 as the lead 21 is received through an opening 28 in the collar member 27, the collar member 27 having a bifurcated extension 29 projecting from the right hand end thereof whereby the spring fingers 26 of the contact member 23 are adapted to extend radially outwardly through slot means 30 that are defined by the bifurcated end member 29 for a purpose hereinafter described.

Figure 3:
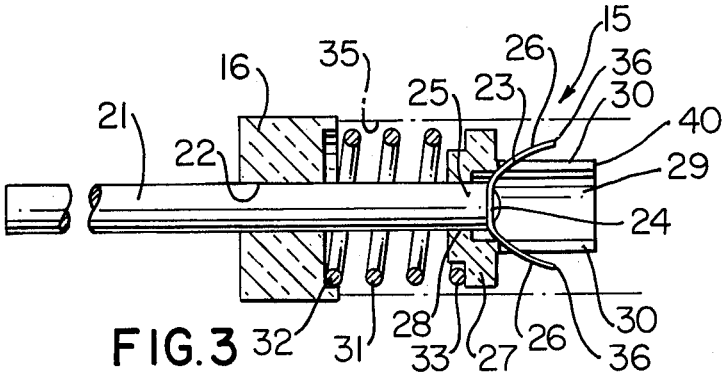
FIG. 3 is a view similar to FIG. 1 and illustrates a subassembly of this invention that is adapted to be inserted into the casing of FIG. 2 to form the switch construction of FIG. 1.
Figure 4:
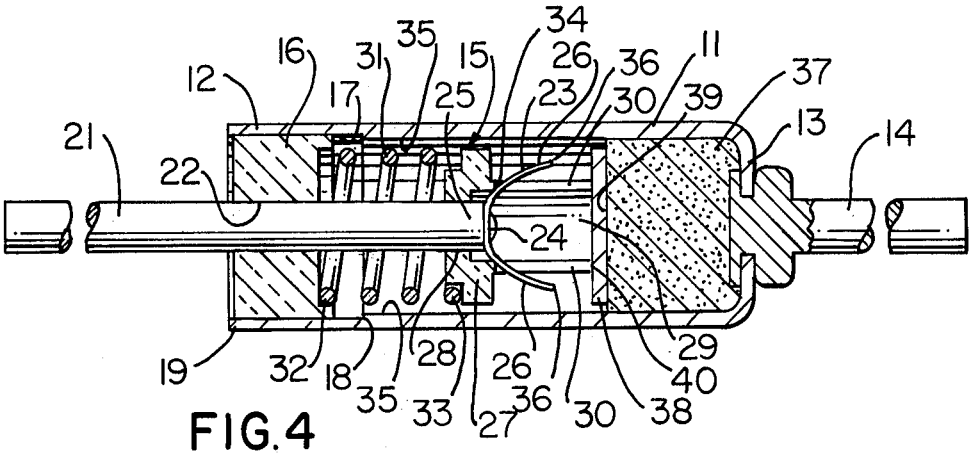
FIG. 4 is a view similar to FIG. 1 and illustrates the method of inserting the subassembly of FIG. 3 into the casing of FIG. 2 during the making of the switch construction of FIG. 1.

A compression spring 31 is also telescopically disposed on the lead 21 intermediate the end plug 16 and the deforming means 27 and has one end 32 bearing against the end plug 16 and the other end 33 bearing against the deforming means 27 so as to tend to slide the deforming means 27 to the right in the drawings and cause a shoulder means 34 at the left-hand end of the slots 30 of the extension 29 of the deforming means 27 to engage against the spring fingers 26 and deform the same toward each other as illustrated in FIGS. 3 and 4. In this manner, the fingers 26 would be held out of electrical contact with the internal peripheral surface 35 of the conductive casing 11 when the spring 31 is holding the deforming means 27 to the right as illustrated in FIG. 3, the internal peripheral surface 35 of the casing 11 being depicted by dashed lines 35 in FIG. 3 to fully illustrate how the spring fingers 26 are deformed by the compression spring 31 and deforming means 27 to have their extreme outer end means 36 completely disposed out of electrical contact with the internal peripheral surface of the casing 11 when the end plug 16 is initially inserted into the couterbore 17 of the casing 11 as illustrated in FIG. 4.

A temperature sensitive member 37, provided in a solid pellet form, is adapted to be diposed into the casing 11 and be disposed against the closed end 13 thereof. If desired, a force spreader member 38 can also be disposed in the casing 11 against the left-hand side 39 of the pellet member 37 for a purpose well known in the art.

Figure 2:
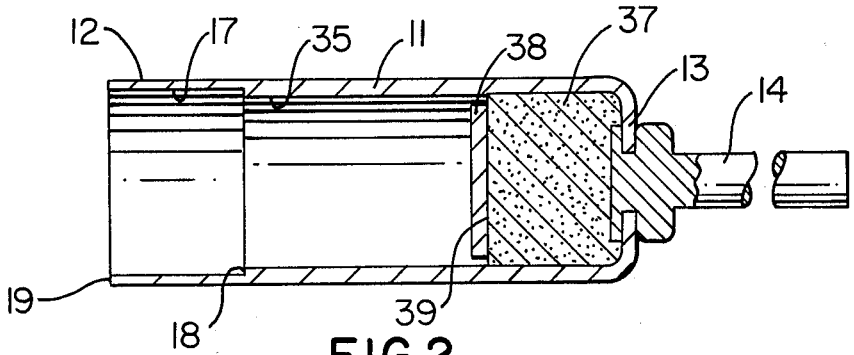
FIG. 2 is a view similar to FIG. 1 and illustrates the casing for making the switch construction of FIG. 1.

Thus, it can be seen in FIG. 2 that when making the thermally actuatable electrical switch construction 10 of FIG. 1, a first subassembly can be provided by the casing 11 merely having the pellet material 37 and force spreader member 38 disposed therein after the lead 14 has been secured therto in any desired manner.

Thereafter, the subassembly 15 of FIG. 3 is adapted to be inserted into the open end 12 of the casing 11 of FIG. 2 in the manner illustrated in FIG. 4.

However, as the subassembly 15 is being inserted down into the casing 11, the end 40 of the extension 29 of the deforming member 27 abuts against the force spreader 38 well before the end plug 16 bottoms out against the shoulder 18 of the casing 11 as illustrated in FIG. 4 whereby further insertion of the subassembly 15 into the casing 11 now causes the contact member 23 to move away to the right from the deforming means or collar 27 to further compress the compression spring 31 between the end plug 16 and collar 27 to store energy therein for a purpose hereinafter described. As the spring fingers 26 are moved to the right away from the shoulder 34 of the deforming means 27 by the further insertion of the subassembly 15 into the casing 11 in the above manner, the spring fingers 26, through their natural resiliency, bow outwardly to place their conductive ends 36 into electrical contact with the internal peripheral surface 35 of the casing 11 in the manner illustrated in FIG. 1 so that once the end plug 16 bottoms out against the shoulder 18 and the end 19 of the casing 11 is crimped over the end plug 16 to secure the end plug 16 in place as illustrated in FIG. 1, the deforming means 27 is held away from the spring fingers 26 of the contact member 23 by the solid temperature sensitive member 37 being in contact, through the force spreader 38, with the extension 29. Thus, an electrical circuit can be completed through the thermally actuatable electrical switch construction 10 between the leads 21 and 14 thereof through the casing 11 and contact member 23.

However, during the operation of the thermally actuatable switch construction 10, the temperature sensitive member 37 only remains in the solid condition illustrated in FIG. 1 as long as the same is sensing a temperature below a predetermined temperature. Thus, when the temperature sensitive member 37 senses a temperature above the predetermined temperature, the temperature sensitive member 37 melts and rapidly changes from the solid state thereof to a liquid state and thereby completely collapses so that the energy in the compression spring 31 rapidly drives the deforming means 27 to the right toward the spring fingers 26 to have the surface 34 thereof cam against the fingers 26 and deform the same inwardly toward each other as illustrated in FIG. 3 whereby the ends 36 thereof will be completely moved and deformed out of electrical contact with the internal peripheral surface 35 of the casing 11 to thereby break the electrical circuit between the leads 21 and 14 thereof.

Therefore, it can be seen that once the temperature sensitive member 37 collapses so that the compression spring 31 can drive the deforming means 27 to the right in FIG. 1 and deform the spring fingers 26 inwardly, the thus tripped switch construction 10 must be replaced in the electrical line carrying the same as the tripped switch construction 10 completely breaks the circuit between the leads 14 and 21 thereof and thereby prevents current flow between the leads 14 and 21 should an unsafe temperature be sensed by the device 10.

Thus, it can be seen that the subassembly 15 of this invention can readily be inserted into the casing 11 of FIG. 2 to form the switch construction 10 of FIG. 1 whereby the deforming means 27 will deform the contact member 26 in a direction toward the temperature sensitive member 37 when the temperature sensitive member 37 collapses by sensing a predetermined temperature, the subassembly 15 being easily inserted into the casing 11 during the making of the thermally actuatable switch construction 10 in a manner believed unique in the art.

Accordingly, it can be seen that this invention not only provides an improved thermally actuatable switch construction and method of making the same, but this invention also provides an improved subassembly for such a thermally actuatable electrical switch construction and method of making such subassembly.

While the forms and methods of this invention, now preferred, have been described and illustrated as required by the Patent Statute, it is to be understood that other forms and method steps can be utilized and still fall within the scope of the appended claims.

What is claimed is:

1. In a thermally actuatable electrical switch construction having a deformable contact member normally disposed in electrical contact with a stationary contact member while a temperature sensitive member of said construction is in a solid condition and being deformed out of contact with said stationary contact member by deforming means of said construction when said temperature sensitive member is rendered non-solid by sensing a temperature above a predetermined temperature, the improvement wherein said deformable contact member is deformed in a direction toward said temperature sensitive member by said deforming means when said temperature sensitive member is rendered non-solid, said deformable contact member being carried by a lead that projects into said construction and is secured thereto by an insulating end plug.

2. A switch construction as set forth in claim 1 wherein said deforming means is also carried by said lead and is disposed between said end plug and said deformable contact member.

3. A switch construction as set forth in claim 2 wherein said deforming means comprises a collar-like member telescopically disposed on said lead and movable relative thereto and a compression spring also telescopically disposed on said lead and bearing against said end plug and said collar-like member to tend to move said collar-like member to engage and deform said deformable member.

4. A switch construction as set forth in claim 3 wherein said end plug, lead, deformable contact member and said deforming means comprise a subassembly that was initially inserted into said construction as a unit to be secured thereto.

5. In a thermally actuatable electrical switch construction having a deformable contact member normally disposed in electrical contact with a stationary contact member while a temperature sensitive member of said construction is in a solid condition and being deformed out of contact with said stationary contact member by deforming means of said construction when said temperature sensitive member is rendered non-solid by sensing a temperature above a predetermined temperature, the improvement wherein said construction has a lead projecting therein and said deformable contact member is fixedly secured to said lead to be carried thereby and be non-movable relative thereto except for a part thereof which is moved only through a deforming thereof.

6. A switch construction as set forth in claim 5 wherein said construction has an insulating end plug supporting said lead in said construction, said lead, end plug and deformable contact member being a subassembly that initially was inserted as a unit into said construction to be secured thereto.

7. In a thermally actuatable electrical switch construction having a deformable contact member normally disposed in electrical contact with a stationary contact member while a temperature sensitive member of said construction is in a solid condition and being deformed out of contact with said stationary contact member by deforming means of said construction when said temperature sensitive member is rendered non-solid by sensing a temperature above a predetermined temperature, the improvement wherein said construction has a lead projecting therein and said deformable contact member is secured to said lead to be carried thereby, said construction having an insulating end plug supporting said lead in said construction, said lead, end plug and deformable contact member being a subassembly that initially was inserted as a unit into said construction to be secured thereto, said deforming means also being carried by said lead and thereby forming part of said subassembly.

8. A switch construction as set forth in claim 5 wherein said deformable contact member is secured to one end of said lead.

9. A switch construction as set forth in claim 8 wherein said deformable contact member has a pair of spring legs extending outwardly from said one end of said lead to engage said stationary contact member.

10. A self-contained subassembly for a thermally actuatable electrical switch construction having a deformable contact member normally disposed in electrical contact with a stationary contact member while a temperature sensitive member of said construction is in a solid condition and being deformed out of contact with said stationary contact member by deforming means of said construction when said temperature sensitive member is rendered non-solid by sensing a temperature above a predetermined temperature, said subassembly comprising a lead adapted to project into said construction and be carried thereby, said deformable contact member being fixedly secured to said lead to be carried thereby and be non-movable relative thereto except for a part thereof which is moved only through a deforming thereof whereby said lead and deformable contact member are adapted to be a self-contained subassembly that is adapted to be initially inserted into said construction to be secured thereto.

11. A subassembly as set forth in claim 10 wherein an insulating end plug for supporting said lead in said construction is also carried by said lead to form part of said subassembly.

12. A subassembly for a thermally actuatable electrical switch construction having a deformable contact member normally disposed in electrical contact with a stationary contact member while a temperature sensitive member of said construction is in a solid condition and being deformed out of contact with said stationary contact member by deforming means of said construction when said temperature sensitive member is rendered non-solid by sensing a temperature above a predetermined temperature, said subassembly comprising a lead adapted to project into said construction and be carried thereby, said deformable contact member being secured to said lead whereby said lead and deformable contact member are adapted to be a subassembly that is adapted to be initially inserted into said construction to be secured thereto, an insulating end plug for supporting said lead in said construction being also carried by said lead to form part of said subassembly, said deforming means also being carried by said lead and thereby forming part of said subassembly.

13. A subassembly as set forth in claim 10 wherein said deformable contact member is secured to one end of said lead.

14. A subassembly as set forth in claim 13 wherein said deformable contact member has a pair of spring legs extending outwardly from said one end of said lead to be adapted to engage said stationary contact member.

* * * * *